US011132965B2

(12) United States Patent
Kang

(10) Patent No.: US 11,132,965 B2
(45) Date of Patent: Sep. 28, 2021

(54) DRIVING METHOD FOR LIQUID CRYSTAL DISPLAY DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC CORPORATION LIMITED, Shenzhen Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/040,678

(22) PCT Filed: Nov. 13, 2018

(86) PCT No.: PCT/CN2018/115173

§ 371 (c)(1),
(2) Date: Sep. 23, 2020

(87) PCT Pub. No.: WO2019/184379

PCT Pub. Date: Oct. 3, 2019

(65) Prior Publication Data

US 2021/0049970 A1 Feb. 18, 2021

(30) Foreign Application Priority Data

Mar. 30, 2018 (CN) ..... 201810292285.9

(51) Int. Cl.
*G09G 3/34* (2006.01)
*G09G 3/36* (2006.01)

(52) U.S. Cl.
CPC ..... *G09G 3/3607* (2013.01); *G09G 3/342* (2013.01); *G09G 3/3413* (2013.01);
(Continued)

(58) Field of Classification Search
CPC .... G09G 3/3607; G09G 3/3413; G09G 3/342; G09G 2300/0452; G09G 2300/0233;
(Continued)

(56) References Cited

U.S. PATENT DOCUMENTS 9,035,867 B2 5/2015 Yoshida
2016/0104438 A1* 4/2016 Han ..... G09G 3/3413 345/690

(Continued)

FOREIGN PATENT DOCUMENTS

CN 103390390 A 11/2013
CN 104575405 A 4/2015

(Continued)

OTHER PUBLICATIONS

International Search Report from International Application No. PCT/CN2018/115173 dated Feb. 11, 2019.

*Primary Examiner* — Dennis P Joseph
(74) *Attorney, Agent, or Firm* — Dorsey & Whitney LLP

(57) ABSTRACT

This application relates to a driving method for a display device. The method includes decomposing an original gray-scale data group of a pixel unit into three gray-scale data groups, and then, when the decomposed gray-scale data groups are displayed, closing a backlight unit with a color corresponding to 0 gray-scale data that are in the same color and in the vast majority.

20 Claims, 6 Drawing Sheets

(52) U.S. Cl.
CPC . *G09G 2300/0452* (2013.01); *G09G 2310/08* (2013.01); *G09G 2320/0233* (2013.01); *G09G 2320/0242* (2013.01); *G09G 2320/0252* (2013.01); *G09G 2330/021* (2013.01); *G09G 2360/16* (2013.01)

(58) Field of Classification Search
CPC ... G09G 2320/0242; G09G 2320/0252; G09G 2360/16; G09G 2340/06
See application file for complete search history.

(56) References Cited

U.S. PATENT DOCUMENTS

| | | | | |
|---|---|---|---|---|
| 2017/0110064 | A1* | 4/2017 | Zhang | G09G 3/2018 |
| 2019/0251914 | A1* | 8/2019 | Chen | G09G 3/342 |

FOREIGN PATENT DOCUMENTS

| | | | |
|---|---|---|---|
| CN | 106782371 | A | 5/2017 |
| CN | 107657928 | A | 2/2018 |
| CN | 107799079 | A | 3/2018 |
| CN | 107808648 | A | 3/2018 |
| CN | 107993624 | A | 5/2018 |
| CN | 108510951 | A | 9/2018 |

* cited by examiner

DRIVING METHOD FOR LIQUID CRYSTAL DISPLAY DEVICE

TECHNICAL FIELD

This application relates to the technical field of liquid crystal display, and in particular, to a driving method for a liquid crystal display device.

BACKGROUND

Among the large viewing angle and frontal viewing angle color shift variations of various representative color systems of liquid crystal displays, the red, green and blue color systems have more serious large viewing angle color shift than other color systems. Furthermore, due to the rapid saturation enhancement of the viewing angle brightness ratio of the gray scale liquid crystal display, the lower the gray scale value is, the greater the difference between the frontal viewing angle brightness and the side viewing angle brightness is.

The current method for improving color shift is as follows: each sub-pixel is subdivided into a primary pixel and a secondary pixel, the primary pixel is driven by a higher driving voltage, the secondary pixel is driven by a lower drive voltage, and the primary pixel and the secondary pixel together display one sub-pixel. When the primary pixel and the secondary pixel are respectively driven by the higher driving voltage and the lower driving voltage, the relationship between the brightness in the front viewing angle and the corresponding gray scale can be maintained unchanged. The method is generally as follows: in the first half of the gray scale, the primary pixel is driven by the higher driving voltage for display, the secondary pixel does not display, the brightness of the entire sub-pixel is half of the brightness of the primary pixel; and in the latter half of the gray scale, the primary pixel is driven by the higher driving voltage for display, the secondary pixel is driven by the lower drive voltage for display, and the brightness of the entire sub-pixel is half of the sum of the brightness of the primary pixel and the brightness of the secondary pixel. After such synthesis, the color shift at a large viewing angle is improved, however, it is necessary to double the metal routing and driving devices to drive the secondary pixel, so that the transmittance and aperture ratio of the panel are affected, and the production cost is increased.

SUMMARY

Based on this, this application provides a driving method for a liquid crystal display device, so as to resolve the problem of color shift at a large view angle, and meanwhile guarantee that the cost is not improved.

This application provides a driving method for a liquid crystal display device, wherein the liquid crystal display device comprises a display module and a backlight module; the display module comprises a plurality of pixel units arranged in an array, and the pixel unit comprises a red sub-pixel, a green sub-pixel, and a blue sub-pixel; a color generated by the pixel unit every time is of any of the following three types: a unitary color, a binary mixed color, and a ternary mixed color; the backlight module is provided with a plurality of backlight units; the backlight unit comprises a red light source, a green light source, and a blue light source; the display module is divided into at least two mutually independent display areas; and the display area corresponds to at least one of the backlight units, and the backlight units corresponding to different display areas are mutually independent, and wherein the driving method comprises:

calculating, respectively, an average gray-scale value of the red sub-pixel, an average gray-scale value of the green sub-pixel, and an average gray-scale value of the blue sub-pixel from gray-scale values corresponding to original gray-scale data to be displayed in each of the display areas;

determining the magnitudes of the average gray-scale value of the red sub-pixel, the average gray-scale value of the green sub-pixel, and the average gray-scale value of the blue sub-pixel in each of the display areas;

determining, respectively, whether a pixel block constituted by a plurality of pixel units, each of which contains a color of the minimum gray-scale value differs from the color of the minimum average gray-scale value in a display area in which the pixel unit is located, is to be produced in each of the display areas by a gray-scale data group to be displayed, and whether the number of pixel units, each of which has a gray-scale value with the same color as the minimum average gray-scale value and greater than or equal to a first set gray-scale value, in the pixel units constituting the pixel block reaches a first set value; and if yes, maintaining a light source of a color corresponding to the minimum average gray-scale value in a backlight unit corresponding to the display area to be opened during a time period of displaying the gray-scale data group.

Based on the same inventive concept, this application further provides another driving method for a liquid crystal display device, wherein the liquid crystal display device comprises a display module and a backlight module; the display module comprises a plurality of pixel units arranged in an array, and the pixel unit comprises a red sub-pixel, a green sub-pixel, and a blue sub-pixel; a color generated by the pixel unit every time is of any of the following three types: a unitary color, a binary mixed color, and a ternary mixed color; the backlight module is provided with a plurality of backlight units; the backlight unit comprises a red light source, a green light source, and a blue light source; the display module is divided into at least two mutually independent display areas; and the display area corresponds to at least one of the backlight units, and the backlight units corresponding to different display areas are mutually independent, and wherein the driving method comprises:

calculating an average gray-scale value of the red sub-pixel, an average gray-scale value of the green sub-pixel, and an average gray-scale value of the blue sub-pixel from gray-scale values corresponding to original gray-scale data to be displayed in a $N^{th}$ display area, and determining the magnitudes of the average gray-scale value of the red sub-pixel, the average gray-scale value of the green sub-pixel, and the average gray-scale value of the blue sub-pixel in the $N^{th}$ display area; and determining whether a pixel block constituted by a plurality of pixel units, each of which contains a color of the minimum gray-scale value differs from the color of the minimum average gray-scale value in a display area in which the pixel unit is located, is to be produced in the $N^{th}$ display area by a gray-scale data group to be displayed, and whether the number of pixel units, each of which has a gray-scale value with the same color as the minimum average gray-scale value and greater than or equal to a first set gray-scale value, in the pixel units constituting the pixel block reaches a first set value; and if yes, maintaining a gray-scale value of the color corresponding to the minimum average gray-scale value in the display area to be unchanged during a time period of displaying the gray-scale data group, wherein N is an integer greater than or equal to 1.

The driving method for a liquid crystal display device mentioned above involves: decomposing the original gray-scale data group into two gray-scale data groups, that is, a first gray-scale data group and a second gray-scale data group by a set grouping rule, and displaying them in two consecutive time period respectively; and proportioning a pixel unit in which there is a larger impact on a displayed color by setting a gray-scale value of the same color as the minimum average gray-scale value in the display area to 0; and controlling, according to the proportion, whether to set the gray-scale value of the color corresponding to the minimum average gray-scale value in the display area to 0 during a time period of displaying the second gray-scale data group. Through such setting, the brightness ratio of the dominant hue is increased, so that the color shift due to that the fact that the large viewing angle dominant hue is affected by a low voltage sub-pixel is alleviated, and meanwhile, the main signal brightness presentation under a large viewing angle is increased. The brightness of the overall image display can be maintained unchanged by increasing the backlight brightness to twice the original brightness, and the speed of the overall image display can be maintained unchanged by increasing a driving frequency to twice an original driving frequency. This may also achieve energy saving while alleviating color shift. Not only may the reality of graphic and text colors be guaranteed, but also additional wiring on a liquid crystal panel is not required, etc.

DETAILED DESCRIPTION OF THE EMBODIMENTS

To make the objectives, technical solutions, and advantages of this application clearer and more comprehensible, the following further describes this application in detail with reference to the accompanying drawings and embodiments. It should be understood that the specific embodiments described herein are merely used to explain this application but are not intended to limit this application.

Figure 1:
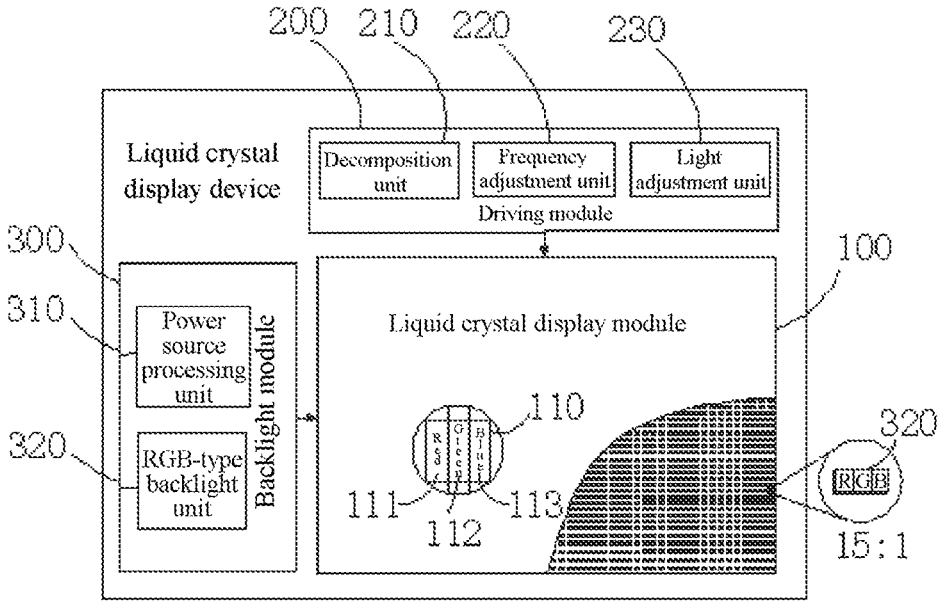
FIG. 1 is a schematic diagram of module constitution of a liquid crystal display device according to an embodiment.

This application provides a driving method for a liquid crystal display device, and as shown in FIG. 1, the liquid crystal display device includes a display module 100, a driving module 200, and a backlight module 300. The display module 100 includes a plurality of pixel units 110 arranged in an array, and the pixel unit 110 includes a red sub-pixel 111, a green sub-pixel 112, and a blue sub-pixel 113. The pixel unit 110 generates a color every time it receives a gray-scale value group. The gray-scale value group is generated by gray-scale data input into the display device. The gray-scale value group includes a red gray-scale value, a green gray-scale value, and a blue gray-scale value. The color generated by the pixel unit 110 every time is of any of the following three types: a unitary color, a binary mixed color, and a ternary mixed color. The backlight module 300 includes a power source processing unit 310 and a backlight unit 320. The display module 100 is used to display graphic and text information. The driving module 200 is used to receive, process and output driving data, so as to control the display module to work normally. The backlight module 300 is used to process a current and light the backlight unit 320. The driving module 200 includes a gray-scale data decomposition processing unit 210, a driving frequency adjustment unit 220, and a backlight adjustment module 230, and the gray-scale data decomposition processing unit 210 is used to decompose gray-scale data and output a gray-scale value signal. The driving frequency adjustment unit 220 is used to adjust a driving frequency. The backlight adjustment unit 230 is used to adjust the color and brightness of the backlight unit 320. The backlight unit 320 includes a red light source, a green light source, and a blue light source. The display module 100 is divided into at least two mutually independent display areas. The display area corresponds to at least one backlight unit 320, and the backlight units 320 corresponding to different display areas are mutually independent. The driving method includes:

calculating, respectively, average gray-scale values of the red sub-pixel 111, the green sub-pixel 112, and the blue sub-pixel 113 from gray-scale values corresponding to original gray-scale data to be displayed in each display area, and determining the magnitudes of the average gray-scale values of the red sub-pixel 111, the green sub-pixel 112, and the blue sub-pixel 113 in each display area; and determining, respectively, whether a pixel block constituted by a plurality of pixel units 110, each of which contains a color of the minimum gray-scale value differs from the color of the minimum average gray-scale value in a display area in which the pixel unit is located, is to be produced in each display area by a gray-scale data group to be displayed, and whether the number of pixel units 110, each of which has a gray-scale value with the same color as the minimum average gray-scale value and greater than or equal to a first set gray-scale value, in the pixel units 110 constituting the pixel block reaches a first set value; and if yes, maintaining a light source of a color corresponding to the minimum average gray-scale value in a backlight unit 320 corresponding to the display area to be opened during a time period of displaying the gray-scale data group.

When the display areas in the display module are divided in a physical manner, all display areas are fixed and relatively independent. Patterns displayed in each display area are different according to general requirements, only one color is displayed in some display areas, and two or more colors are displayed in some display areas. Alternatively, basically, only unitary color, only binary mixed color or only ternary mixed color is displayed in some display areas, while a combination of any two or three of a unitary color, a binary mixed color or a ternary mixed color may be displayed in some display areas. In some display areas, although pixel units 110 of a certain mixed color type are less in a certain displaying stage, when they are centralized in a pixel block of a certain range, closing the light source of the color corresponding to the minimum average gray-scale value in the backlight unit 320 corresponding to the display area or setting the gray-scale value of the color corresponding to the minimum average gray-scale value in the display area to 0 according to a general control method may affect image quality. Severely, it may affect image integrity. Therefore, under a general control rule, such circumstances need to be controlled more precisely. Moreover, when the display area has a pixel block constituted by a plurality of pixel units 110 each of which contains a color of the minimum gray-scale value differs from the color of the minimum average gray-scale value in the display area, and the number of pixel units 110 each of which has the same color as the minimum average gray-scale value in the display area and has a gray-scale value greater than or equal to the first set gray-scale value in the pixel units 110 constituting the pixel block reaches a pre-set value, the light source of a color corresponding to the minimum average gray-scale value in the backlight unit 320 corresponding to the display area is maintained to be opened during the time period of displaying the gray-scale data group. The feature that "the display area has a pixel block constituted by a plurality of pixel units 110 each of which contains a color of the minimum gray-scale value differs from the color of the minimum average gray-scale value in the display area" means, although an average gray-scale value of a certain color is the minimum for the whole display area, for a certain pixel block in the display area, the average gray-scale value of the color is not the minimum in the pixel block. In addition, when "the number of pixel units 110 each of which has the same color as the minimum average gray-scale value in the display area and has a gray-scale value greater than or equal to the first set gray-scale value in the pixel units 110 constituting the pixel block reaches a pre-set value", that is, when the impact of the color on the pixel block cannot be ignored, the light source of the color corresponding to the minimum average gray-scale value in the backlight unit 320 corresponding to the display area needs to be maintained to be opened during the time period of displaying the gray-scale data group, instead of closing the light source of the color corresponding to the minimum average gray-scale value in the backlight unit 320 corresponding to the display area according to a common practice. Otherwise, this may affect image quality or image integrity. For example, a certain display area is further divided into a first pixel block, a second pixel block, and a third pixel block, the first pixel block displays a red unitary color, the second pixel block displays a green unitary color, the third pixel block displays a blue unit, the area of the first pixel block is greater than the second pixel block, and the area of the second pixel block is greater than the third pixel block. At this point, for the whole display area, the average gray-scale value of the blue sub-pixel is the minimum, but for the third pixel block, the blue sub-pixel is the main color, and if a light source of the color corresponding to the blue sub-pixel with the minimum average gray-scale value in the display area is closed at this point, the third pixel block may not be displayed, which may severely affect an originally displayed image.

In an embodiment, the driving method further includes: determining whether, in the pixel units 110 each of which contains a color of the minimum gray-scale value differs from the color of the minimum average gray-scale value in the display area in which the pixel unit is located in each display area, the number of pixel units 110 with the same color as the minimum average gray-scale value in the display area and a gray-scale value greater than or equal to a second set gray-scale value reaches a second set value; and if yes, maintaining the light source of the color corresponding to the minimum average gray-scale value in the backlight unit 320 corresponding to the display area to be opened during the time period of displaying the gray-scale data group; otherwise, closing the light source of the color corresponding to the minimum average gray-scale value in the backlight unit 320 corresponding to the display area or setting the gray-scale value of the color corresponding to the minimum average gray-scale value in the display area to 0 during the time period of displaying the gray-scale data group. The first set gray-scale value is less than or equal to the second set gray-scale value. The first set value is less than or equal to the second set value. In this embodiment, in a certain display area, a main color displayed by the pixel unit 110 is same as the color of the minimum average value in the display area. In general, although the main color displayed by the pixel unit 110 is same as the color of the minimum average value in the display area, there are gray-scale values of different magnitude and amount. For pixel units 110 using the color of the minimum average value in the display area as its own main color displayed, the greater the gray-scale value of the color is, the greater its impact on an image is, and the greater the amount is, the greater its impact on the image is. On the contrary, it is reverse. Therefore, under a general control rule, such circumstances need to be controlled more precisely. Moreover, when in pixel units 110 in which the color of the minimum gray-scale value in a gray-scale data group to be displayed in a certain display area differs from the color of the minimum average gray-scale value in the display area, the number of pixel units 110 with the same color as the minimum average gray-scale value in the display area and a gray-scale value greater than or equal to the second set gray-scale value does not reach the pre-set value, the light source of the color corresponding to the minimum average gray-scale value in the backlight unit 320 corresponding to the display area is closed or the gray-scale value corresponding to the minimum gray-scale value in the display area is set to 0. The step describes that in a certain display area, a main color displayed by the pixel unit 110 is same as the color of the minimum average value in the display area. In general, in the event that the main color displayed by the pixel unit 110 is same as the color of the minimum average value in the display area, but all gray-scale values are smaller and less, and the color displayed thereby has less impact on the image, the light source of the color corresponding to the minimum average gray-scale value in the backlight unit 320 corresponding to the display area may be closed, or the gray-scale value of the color corresponding to the minimum average gray-scale value in the display area may be set to 0, thus achieving energy saving while guaranteeing that an original image is less affected.

In an embodiment, the driving method further includes: determining a type of a color corresponding to an original gray-scale data group to be displayed in each pixel unit 110; dividing the original gray-scale data group into a first gray-scale data group and a second gray-scale data group with a set grouping rule according to the type of the color corresponding to the original gray-scale data group to be displayed in each pixel unit 110; and outputting and displaying the first gray-scale data group and the second gray-scale data group in two consecutive time periods respectively. The first gray-scale data group is a ternary mixed color gray-scale data group, a binary mixed color gray-scale data group or a unitary color gray-scale data group. The second gray-scale data group is a binary mixed color gray-scale data group or a unitary color gray-scale data group.

The type of the color corresponding to the original gray-scale data is determined according to the number of 0 gray-scale data in the original gray-scale data group to be displayed in each pixel unit 110. When the original gray-scale data group does not include 0 gray-scale data, the color corresponding to the original gray-scale data group is a ternary mixed color. When the original gray-scale data group includes only one piece of 0 gray-scale data, the color corresponding to the original gray-scale data group is a binary mixed color. When the original gray-scale data group includes only two pieces of 0 gray-scale data, the color corresponding to the original gray-scale data group is a unitary color.

Figure 2:
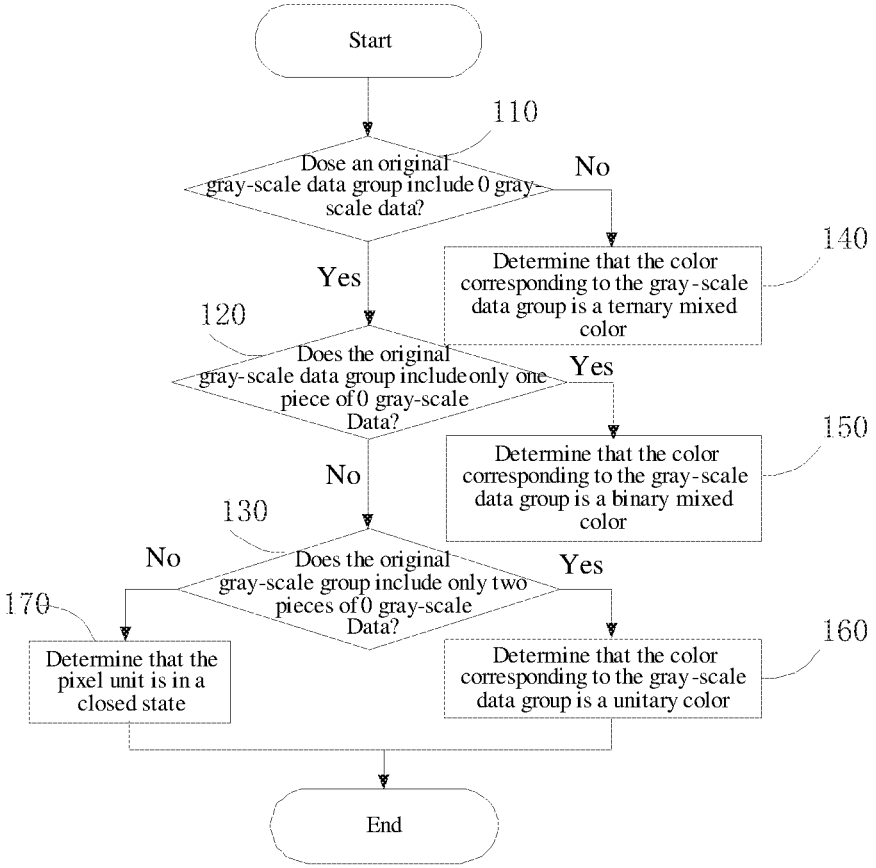
FIG. 2 is a flow chart of a driving method for determining a type of a color displayed by a pixel unit corresponding to an original gray-scale data group according to an embodiment.

Specifically, as shown in FIG. 2, method steps of an embodiment of determining the type of the color corresponding to the original gray-scale data group to be displayed in each pixel unit 110 include S110-S170.

Step S110: Determine whether an original gray-scale data group to be displayed in each pixel unit 110 includes 0 gray-scale data; if not, execute step S140, otherwise; execute step S120. When a certain color is of the type of ternary mixed color, it means that the color includes three color ingredients, that is, red, green and blue, in the technical field of liquid crystal display, none of gray-scale values corresponding to the red sub-pixel, the green sub-pixel, and the blue sub-pixel in the pixel unit 110 is 0, that is, a corresponding original gray-scale data group does not include 0 gray-scale data, and therefore, determination may be performed on whether the original gray-scale data group is a ternary mixed color gray-scale data group by determining whether the original gray-scale data group includes 0 gray-scale data.

Step S120: Determine whether the original gray-scale data group to be displayed in each pixel unit 110 includes only one piece of 0 gray-scale data; and if yes, execute step S150; otherwise, execute step S130. When a certain color is of the type of binary mixed color, it means that the color includes any two of the three color ingredients: red, green and blue, in the technical field of liquid crystal display, only one of the gray-scale values of the red sub-pixel, the green sub-pixel, and the blue sub-pixel in the pixel unit 110 is 0 and the other two are not 0, that is, a corresponding original gray-scale data group includes only one piece of 0 gray-scale data, and therefore, determination may be performed on whether the original gray-scale data group is a binary mixed color gray-scale data group by determining whether the original gray-scale data group includes only one piece of 0 gray-scale data.

Step S130: Determine whether the original gray-scale data group to be displayed in each pixel unit 110 includes only two pieces of 0 gray-scale data; and if yes, execute step S160; otherwise, execute step S170. When a certain color is of the type of unitary color, it means that the color includes any one of the three color ingredients: red, green and blue, in the technical field of liquid crystal display, only two of the gray-scale values of the red sub-pixel, the green sub-pixel, and the blue sub-pixel in the pixel unit 110 are 0 and the other one is not 0, that is, a corresponding original gray-scale data group includes only two pieces of 0 gray-scale data, and therefore, determination may be performed on whether the original gray-scale data group is a unitary color gray-scale data group by determining whether the original gray-scale data group includes only two pieces of 0 gray-scale data.

Step S140: Determine that the color displayed by the pixel unit 110 corresponding to the gray-scale data group is a ternary mixed color.

Step S150: Determine that the color displayed by the pixel unit 110 corresponding to the gray-scale data group is a binary mixed color.

Step S160: Determine that the color displayed by the pixel unit 110 corresponding to the gray-scale data group is a unitary color.

Step S170: Determine that the pixel unit 110 corresponding to the gray-scale data group is in a closed state. When all gray-scale values corresponding to various sub-pixels of a certain pixel unit 110 are 0, it means that the pixel unit 110 does not undertake the task of displaying, at this point, the voltage of various sub-pixels of the pixel unit 110 is 0 and the pixel unit is in a closed state, and since light cannot penetrate a liquid crystal, the pixel unit 110 is presented with black.

Specifically, the grouping rule includes:

using the minimum original gray-scale data in an original gray-scale data group corresponding to a ternary mixed color pixel unit 110 as common gray-scale data of the red sub-pixel 111, the green sub-pixel 112, and the blue sub-pixel 113 in the pixel unit 110, so as to constitute the first gray-scale data group;

using the minimum non-0 gray-scale data in a difference data group obtained by subtracting the first gray-scale data group from the original gray-scale data group corresponding to the ternary mixed color pixel unit 110 as common gray-scale data of sub-pixels corresponding to non-0 gray-scale data in the difference data group, so as to constitute the second gray-scale data group together with 0 gray-scale data;

using a difference data group obtained by subtracting the first gray-scale data group respectively from the original gray-scale data group corresponding to the ternary mixed color pixel unit 110 as a third gray-scale data group;

using the minimum non-0 gray-scale data in an original gray-scale data group corresponding to a binary mixed color pixel unit 110 as common gray-scale data of sub-pixels corresponding to two pieces of non-0 gray-scale data in the pixel unit 110, so as to constitute the first gray-scale data group together with the 0 gray-scale data; using a difference data group obtained by subtracting the first gray-scale data group from the original gray-scale data group as the second gray-scale data group of the pixel unit 110; and using gray-scale data corresponding to a half of gray-scale values corresponding to non-0 gray-scale data in an original gray-scale data group corresponding to a unitary color pixel unit 110 as gray-scale data of sub-pixels corresponding to non-0 gray-scale data in the pixel unit 110, so as to constitute the first gray-scale data group and the second gray-scale data group respectively together with the 0 gray-scale data.

Figure 3:
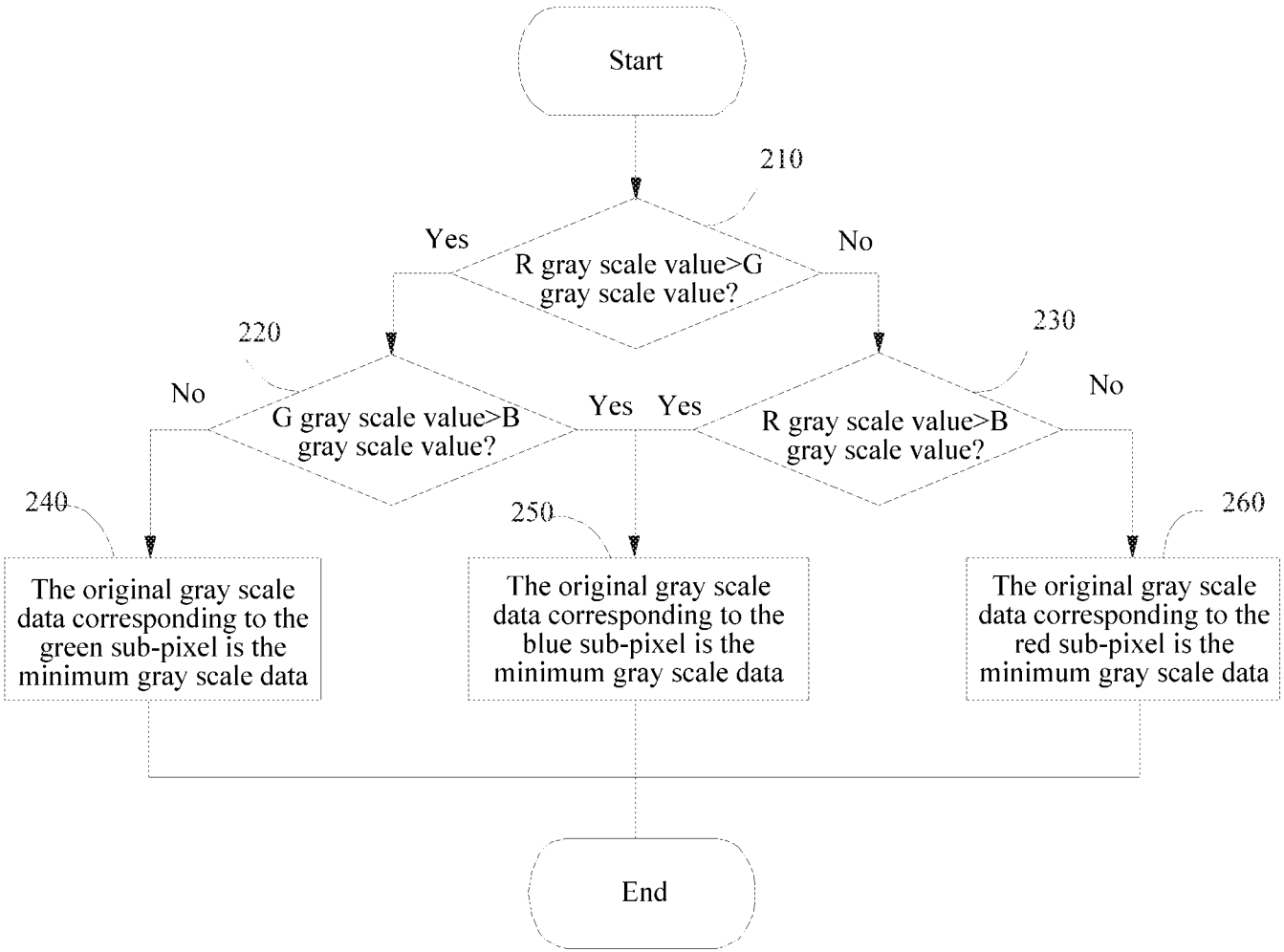
FIG. 3 is a flow chart of a driving method for determining the minimum gray-scale data in a ternary mixed color gray-scale data group according to an embodiment.

An embodiment as shown in FIG. 3 is a method for determining the minimum gray-scale data in the ternary mixed color gray-scale data group, including steps S210-S260.

Step S210: Determine whether a red gray-scale value in an original gray-scale value group corresponding to an original gray-scale data group to be displayed in the ternary mixed color pixel unit 110 is greater than a green gray-scale value; and if yes, execute step S220; otherwise, execute step S230. In the step S210, first determining a relationship of magnitude between the gray-scale value corresponding to the red sub-pixel 111 and the gray-scale value of the green sub-pixel 112 is a circumstance set forth merely for ease of illustration, and in fact, gray-scale values of any two of the red, green, and blue sub-pixels may be employed to perform determination first.

Step S220: Determine whether the green gray-scale value in the original gray-scale value group is greater than a blue gray-scale value; and if yes, execute step S250; otherwise, execute step S240. The step S220 relates to further performing comparison and determination on a smaller gray-scale value in step S120 and a gray-scale value of another color, and outputting a corresponding determination result and action signal.

Step S230: Determine whether the red gray-scale value in the original gray-scale value group is greater than the blue gray-scale value; and if yes, execute step S250; otherwise, execute step S260. The step S230 relates to further performing comparison and determination on a smaller gray-scale value in step S120 and a gray-scale value of another color, and outputting a corresponding determination result and action signal.

Step S240: Determine that gray-scale data corresponding to the green sub-pixel in the original gray-scale data group is the minimum original gray-scale data.

Step S250: Determine that gray-scale data corresponding to the blue sub-pixel in the original gray-scale data group is the minimum original gray-scale data.

Step S260: Determine that gray-scale data corresponding to the red sub-pixel in the original gray-scale data group is the minimum original gray-scale data.

Figure 4:
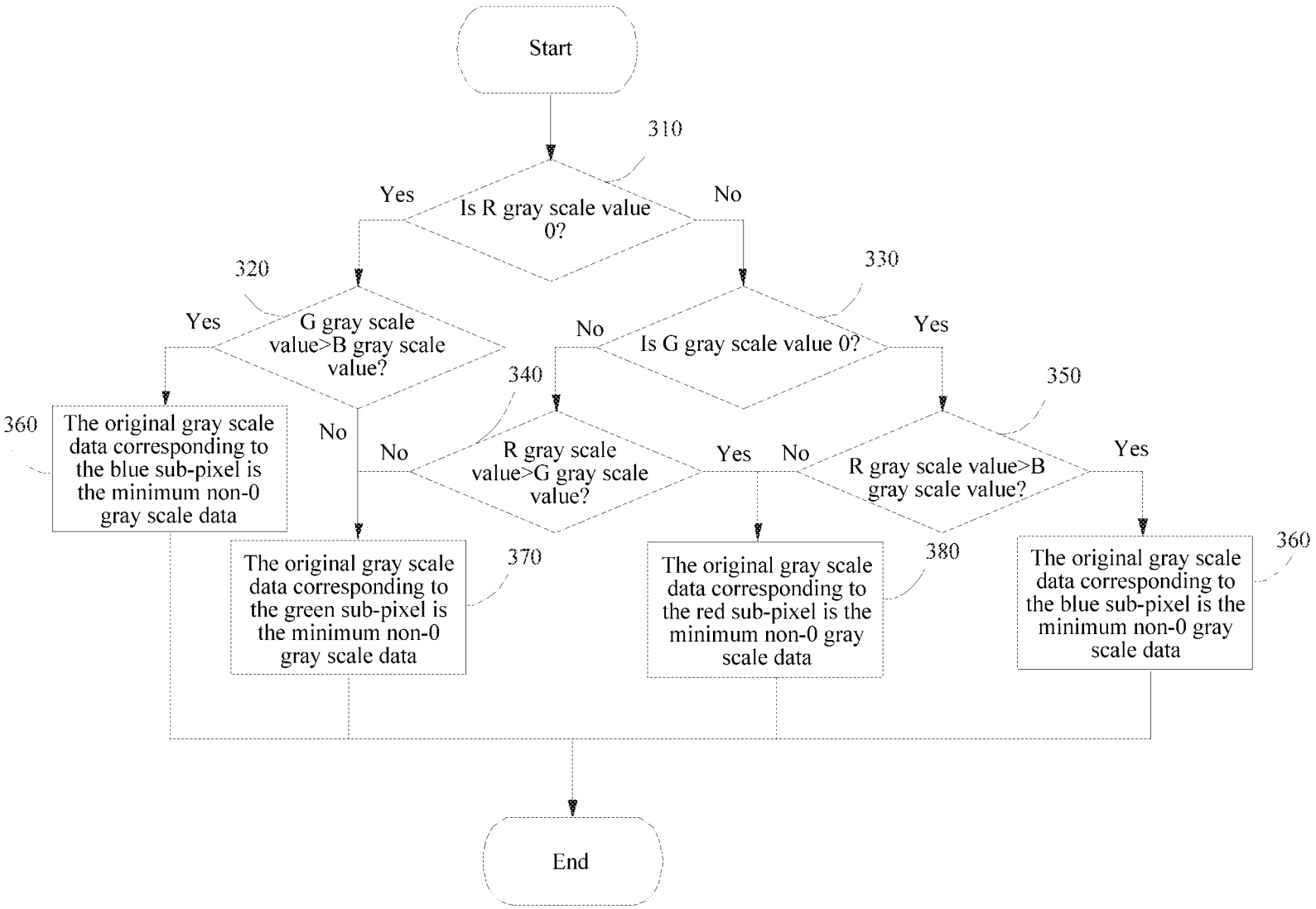
FIG. 4 is a flow chart of a driving method for determining the minimum non-0 gray-scale data in a binary mixed color gray-scale data group according to an embodiment.

An embodiment as shown in FIG. 4 is a method for determining the minimum non-0 gray-scale data in the binary mixed color gray-scale data group, including steps S310-S380.

Step S310: Determine whether a red gray-scale value in an original gray-scale value group corresponding to an original gray-scale data group to be displayed in the binary mixed color pixel unit 110 is 0; and if yes, execute step S320; otherwise, execute step S330.

When a certain color is of the type of binary mixed color, it means that the color includes any two of the three color ingredients: red, green and blue, and in the technical field of liquid crystal display, only one of the gray-scale values of the red sub-pixel, the green sub-pixel, and the blue sub-pixel in the pixel unit 110 is 0 and the other two are not 0, that is, a corresponding original gray-scale data group includes only one piece of 0 gray-scale data. In the step S310, first determining whether the gray-scale value corresponding to the red sub-pixel 111 is 0 is a circumstance set forth merely for ease of illustration, and in fact, a gray-scale value of one of the red, green, and blue sub-pixels may be employed to perform determination first.

Step S320: Determine whether a green gray-scale value corresponding to a pixel unit 110 where the gray-scale value of the red sub-pixel is 0 is greater than a blue gray-scale value; and if yes, execute step S360; otherwise, execute step S370. In the step S320, when the gray-scale value of the red sub-pixel 111 is determined to 0, the color displayed by the pixel unit 110 is determined to be a mixed color of red and blue, and therefore, the minimum non-0 gray-scale data in the original gray-scale data group corresponding to the pixel unit 110 may be determined by determining a relationship of magnitude between the green gray-scale value and the blue gray-scale value.

Step S330: Determine whether a green gray-scale value corresponding to the pixel unit 110 where the gray-scale value of the red sub-pixel is not 0 is 0; and if yes, execute step S350; otherwise, execute step S340. In the step S330, further determining whether the gray-scale value corresponding to the green sub-pixel 112 is 0 after determining that the gray-scale value of the red sub-pixel 111 is not 0 is a circumstance set forth merely for ease of illustration, and in fact, the gray-scale value of the blue sub-pixel may be employed to perform determination as well.

Step S340: Determine whether a red gray-scale value corresponding to a pixel unit 110 where the gray-scale value of the blue sub-pixel is 0 is greater than the green gray-scale value; and if yes, execute step S380; otherwise, execute step S370. In the step S340, when it is determined that the gray-scale value corresponding to the blue sub-pixel 113 is 0, the color displayed by the pixel unit 110 is determined to be a mixed color of green and red, and therefore, the minimum non-0 gray-scale data in the original gray-scale data group corresponding to the pixel unit 110 may be determined by determining a relationship of magnitude between the green gray-scale value and the red gray-scale value.

Step S350: Determine whether a red gray-scale value corresponding to a pixel unit 110 where the gray-scale value of the green sub-pixel is 0 is greater than the blue gray-scale value; and if yes, execute step S360; otherwise, execute step S380. In the step S350, when it is determined that the gray-scale value of the green sub-pixel 112 is 0, the color displayed by the pixel unit 110 is determined to be a mixed color of red and blue, and therefore, the minimum non-0 gray-scale data in the original gray-scale data group corresponding to the pixel unit 110 may be determined by determining a relationship of magnitude between the red gray-scale value and the blue gray-scale value.

Step S360: Determine that gray-scale data corresponding to the blue sub-pixel in the original gray-scale data group corresponding to the binary mixed color pixel unit 110 is the minimum non-0 gray-scale data.

Step S370: Determine that gray-scale data corresponding to the green sub-pixel in the original gray-scale data group corresponding to the binary mixed color pixel unit 110 is the minimum non-0 gray-scale data.

Step S380: Determine that gray-scale data corresponding to the red sub-pixel in the original gray-scale data group corresponding to the binary mixed color pixel unit 110 is the minimum non-0 gray-scale data.

Figure 5:
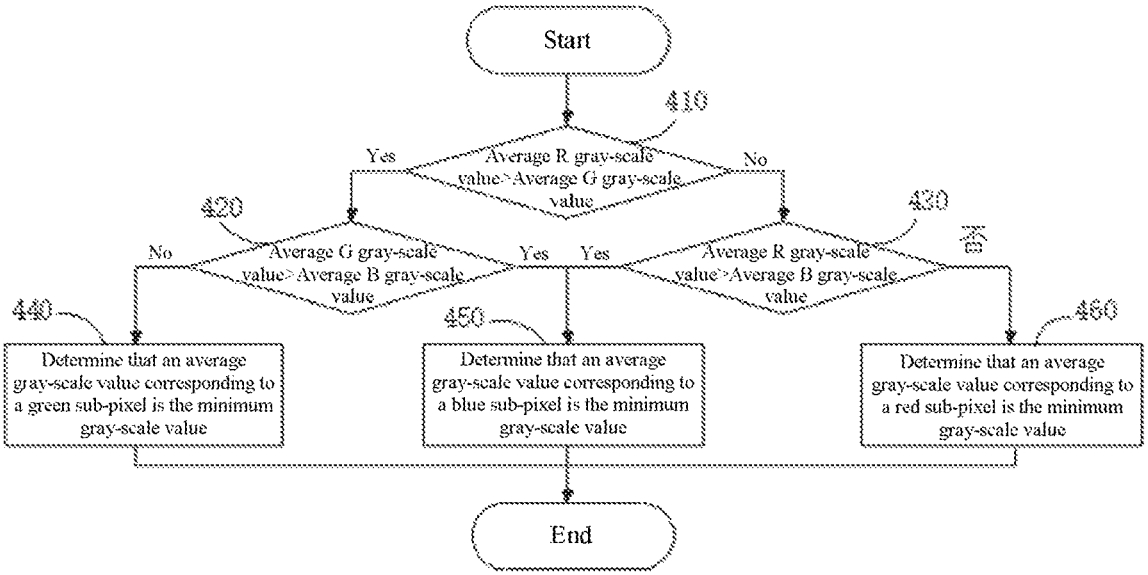
FIG. 5 is a flow chart of determining the minimum value of average gray-scale values of sub-pixels with various colors in a certain display area according to an embodiment.

An embodiment as shown in FIG. 5 is a method for determining the magnitude of the average gray-scale value of the red sub-pixel, the average gray-scale value of the green sub-pixel, and the average gray-scale value of the blue sub-pixel in a certain display area, specifically including steps S410-S460.

Step S410: Determine whether the average gray-scale value of the red sub-pixel in the original gray-scale data group to be displayed in the $N^{th}$ display area is greater than the average gray-scale value of the green sub-pixel; and if yes, execute step S420; otherwise, execute step S430. In the step S410, first determining a relationship of magnitude between the average gray-scale value corresponding to the red sub-pixel 111 and the average gray-scale value corresponding to the green sub-pixel 112 is a circumstance set forth merely for ease of illustration, and in fact, average gray-scale values of any two of the red, green, and blue sub-pixels may be employed to perform determination first.

Step S420: Determine whether the average gray-scale value of the green sub-pixel in the original gray-scale data group to be displayed in the $N^{th}$ display area is greater than the average gray-scale value of the blue sub-pixel; and if yes, execute step S450; otherwise, execute step S440. The step S420 relates to further performing comparison and determination on a smaller average gray-scale value of the green sub-pixel in step S420 and the average gray-scale value of a blue sub-pixel in a display area constituted by the ternary mixed color pixel units 110, and outputting a corresponding determination result and action signal.

Step S430: Determine whether the average gray-scale value of the red sub-pixel in the original gray-scale data group to be displayed in the $N^{th}$ display area is greater than the average gray-scale value of the blue sub-pixel; and if yes, execute step S450; otherwise, execute step S460. The step S430 relates to further performing comparison and determination on a smaller average gray-scale value of the red sub-pixel in step S420 and the average gray-scale value of the blue sub-pixel in the display area constituted by the ternary mixed color pixel units 110, and outputting a corresponding determination result and action signal.

Step S440: Determine that the average gray-scale value of the green sub-pixel in the original gray-scale data group in the $N^{th}$ display area is the minimum average gray-scale value of the $N^{th}$ display area.

Step S450: Determine that the average gray-scale value of the blue sub-pixel in the original gray-scale data group in the $N^{th}$ display area is the minimum average gray-scale value of the $N^{th}$ display area.

Step S460: Determine that the average gray-scale value of the red sub-pixel in the original gray-scale data group in the $N^{th}$ display area is the minimum average gray-scale value of the $N^{th}$ display area.

Figure 6:
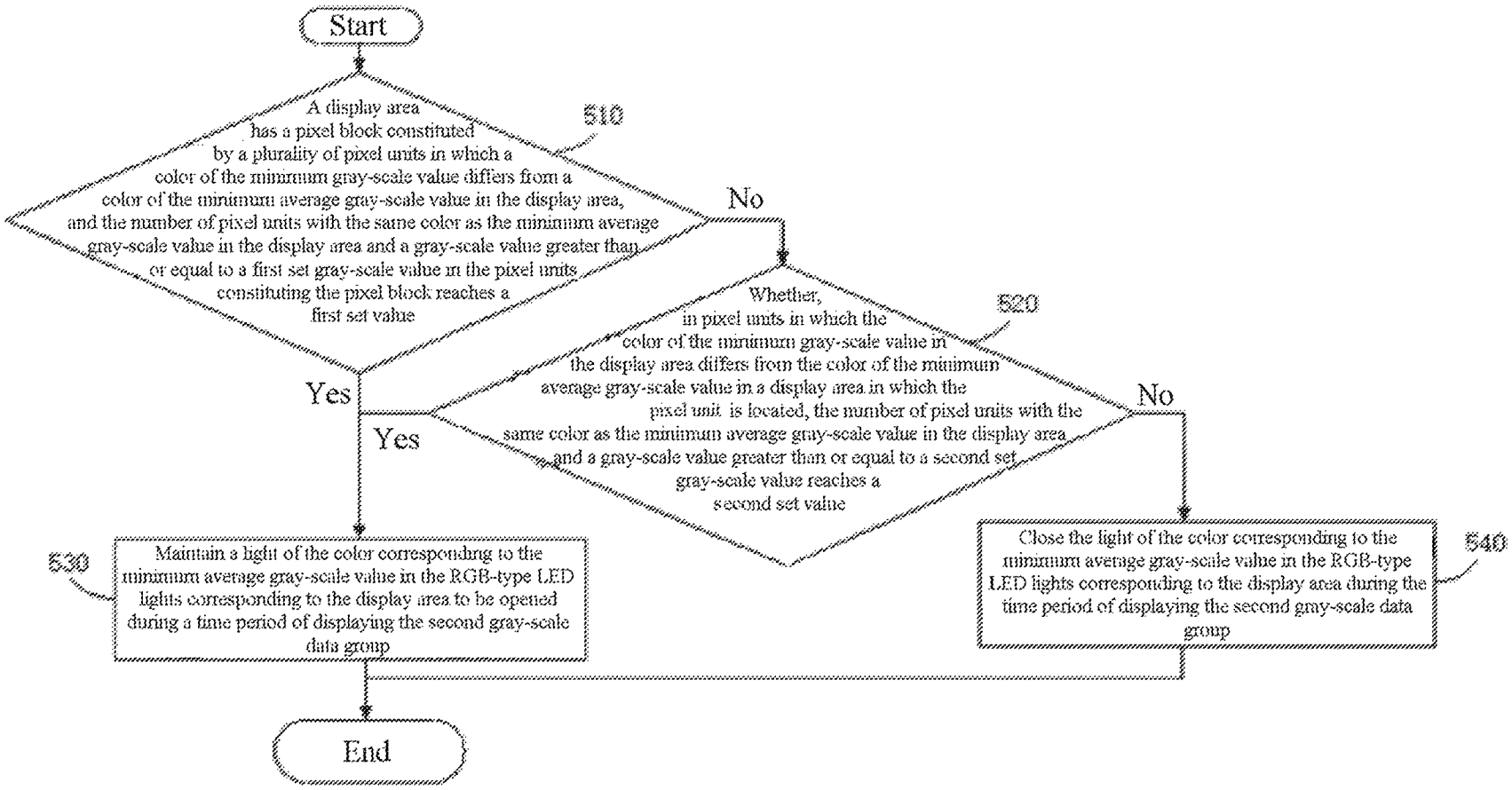
FIG. 6 is a flow chart of determining whether a light source, in a backlight unit corresponding to a certain display area, with the same color as the minimum average gray-scale value in the display area is closed according to an embodiment.

An embodiment as shown in FIG. 6 is a method for determining whether a light source, in a backlight unit 320 corresponding to a certain display area, with the same color as the minimum average gray-scale value in the display area is closed, including steps S510-S540.

Step S510: Determine whether a pixel block constituted by a plurality of pixel units 110 in which the color of the minimum gray-scale value differs from the color of the minimum average gray-scale value in the $N^{th}$ display area is produced in the display area by a gray-scale data group to be displayed in the display area, and whether the number of pixel units 110 with the same color as the minimum average gray-scale value in the display area and a gray-scale value greater than or equal to a first set gray-scale value in the pixel units 110 constituting the pixel block reaches a first set value; and if yes, execute step S530; otherwise, execute step S520. When the display areas in the display module are divided in a physical manner, all display areas are fixed and relatively independent. Patterns displayed in each display area are different according to general requirements, only one color is displayed in some display areas, and two or more colors are displayed in some display areas. Alternatively, basically, only unitary color, only binary mixed color or only ternary mixed color is displayed in some display areas, while a combination of any two or three of a unitary color, a binary mixed color or a ternary mixed color may be displayed in some display areas. In some display areas, although pixel units 110 of a certain mixed color type are less in a certain displaying stage, when they are centralized in a pixel block of a certain range, closing the light source of the color corresponding to the minimum average gray-scale value in the backlight unit 320 corresponding to the display area or setting a gray-scale value of the color corresponding to the minimum average gray-scale value in the display area to 0 according to a general control method may affect the image quality. Severely, it may affect image integrity. Therefore, under a general control rule, such circumstances need to be controlled more precisely.

Step S520: Determine whether, in pixel units 110 in which the color of the minimum gray-scale value in the gray-scale data group to be displayed in the $N^{th}$ display area differs from the color of the minimum average gray-scale value in the display area, the number of pixel units 110 with the same color as the minimum average gray-scale value in the display area and a gray-scale value greater than or equal to a second set gray-scale value reaches a second set value; and if yes, execute step S530; otherwise, execute step S540. The step S520 describes that in a certain display area, a main color displayed by the pixel unit 110 is same as the color of the minimum average value in the display area. In general, although the main color displayed by the pixel unit 110 is same as the color of the minimum average value in the display area, there are gray-scale values of different magnitude and amount. For pixel units 110 using the color of the minimum average value in the display area as its own main color displayed, the greater the gray-scale value of the color is, the greater its impact on an image is, and the greater the amount is, the greater its impact on the image is. On the contrary, it is reverse. Therefore, under a general control rule, such circumstances need to be controlled more precisely.

Step S530: Determine that in the $N^{th}$ display area, the light source of the color corresponding to the minimum average gray-scale value in the backlight unit 320 corresponding to the display area is maintained to be opened during the time period of displaying the gray-scale data group. Moreover, when a display area has a pixel block constituted by a plurality of pixel units 110 in which the color of the minimum gray-scale value differs from the color of the minimum average gray-scale value in the display area, and the number of pixel units 110 with the same color as the minimum average gray-scale value in the display area and a gray-scale value greater than or equal to the first set gray-scale value in the pixel units 110 constituting the pixel block reaches a pre-set value, or when in pixel units 110 in which the color of the minimum gray-scale value in the gray-scale data group to be displayed in a certain display area differs from the color of the minimum average gray-scale value in the display area, the number of pixel units 110 with the same color as the minimum average gray-scale value in the display area and a gray-scale value greater than or equal to the second set gray-scale value does not reach the pre-set value, the light source of the color corresponding to the minimum average gray-scale value in the backlight unit 320 corresponding to the display area is maintained to be opened during the time period of displaying the gray-scale data group. The feature that "the display area has a pixel block constituted by a plurality of pixel units 110 in which the color of the minimum gray-scale value differs from the color of the minimum average gray-scale value in the display area" means, although an average gray-scale value of a certain color is the minimum for the whole display area, for a certain pixel block in the display area, the average gray-scale value of the color is not the minimum in the pixel block. In addition, when "the number of pixel units 110 with the same color as the minimum average gray-scale value in the display area and a gray-scale value greater than or equal to the first set gray-scale value in the pixel units 110 constituting the pixel block reaches a pre-set value", that is, when the impact of the color on the pixel block cannot be ignored, the light source of the color corresponding to the minimum average gray-scale value in the backlight unit 320 corresponding to the display area needs to be maintained to be opened during the time period of displaying the gray-scale data group, instead of closing the light source of the color corresponding to the minimum average gray-scale value in the backlight unit 320 corresponding to the display area according to a common practice. Otherwise, this may affect image quality or image integrity. For example, a certain display area is further divided into a first pixel block, a second pixel block, and a third pixel block, the first pixel block displays a red unitary color, the second pixel block displays a green unitary color, the third pixel block displays a blue unit, the area of the first pixel block is greater than the second pixel block, and the area of the second pixel block is greater than the third pixel block. At this point, for the whole display area, the average gray-scale value of the blue sub-pixel is the minimum, but for the third pixel block, the blue sub-pixel is the main color, and if a light source of the color corresponding to the blue sub-pixel with the minimum average gray-scale value in the display area is closed at this point, the third pixel block may not be displayed, which may severely affect an originally displayed image.

Step S540: Determine that in each display area, the light source of the color corresponding to the minimum average gray-scale value in the backlight unit 320 corresponding to the display area is closed or the gray-scale value of the color corresponding to the minimum average gray-scale value in the display area is set to 0 during the time period of displaying the gray-scale data group. When in pixel units 110 in which the color of the minimum gray-scale value in a gray-scale data group to be displayed in a certain display area differs from the color of the minimum average gray-scale value in the display area, the number of pixel units 110 with the same color as the minimum average gray-scale value in the display area and a gray-scale value greater than or equal to the second set gray-scale value does not reach the pre-set value, the light source of the color corresponding to the minimum average gray-scale value in the backlight unit 320 corresponding to the display area is closed or the gray-scale value of the color corresponding to the minimum gray-scale value in the display area is set to 0. The step S540 describes that in a certain display area, a main color displayed by the pixel unit 110 is same as the color of the minimum average value in the display area. In general, in the event that the main color displayed by the pixel unit 110 is same as the color of the minimum average value in the display area, but all gray-scale values are smaller and less, and the color displayed thereby has less impact on the image, the light source of the color corresponding to the minimum average gray-scale value in the backlight unit 320 corresponding to the display area may be closed, or the gray-scale value of the color corresponding to the minimum average gray-scale value in the display area may be set to 0, thus achieving energy saving while guaranteeing that an original image is less affected.

In the above steps, the gray-scale data group to be displayed may be the first gray-scale data group or the second gray-scale data group. Preferably, the driving control method mentioned above is employed when the second gray-scale data group is displayed.

Figure 7:
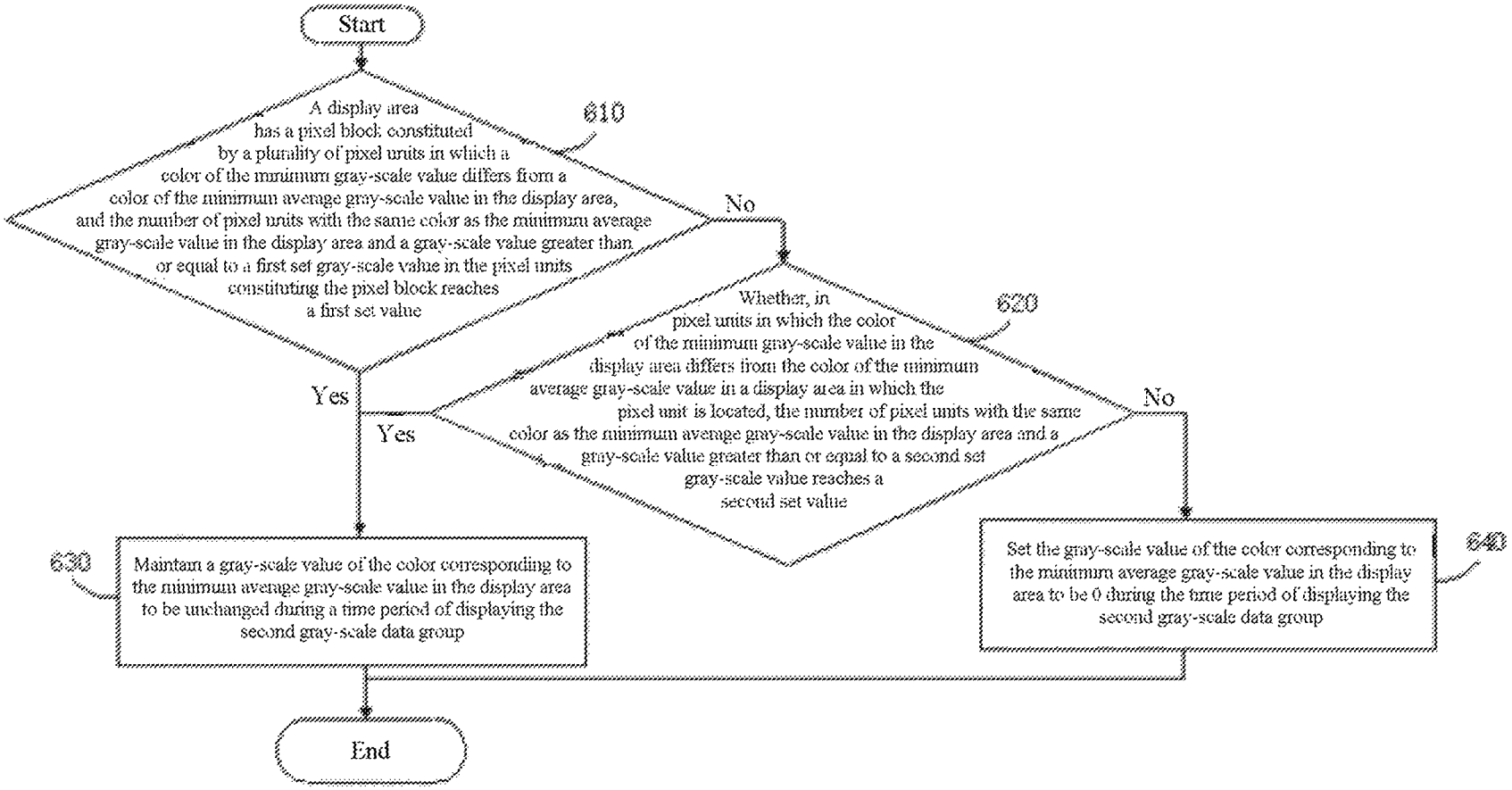
FIG. 7 is a flow chart of determining whether a sub-pixel with a color corresponding to the minimum average gray-scale value in a certain display area is set to 0 according to an embodiment.

An embodiment as shown in FIG. 7 is a method for determining whether a sub-pixel with the color corresponding to the minimum average gray-scale value in a certain display area is set to 0, including steps S610-S640.

Step S610: Determine whether a pixel block constituted by a plurality of pixel units 110 in which the color of the minimum gray-scale value differs from the color of the minimum average gray-scale value in the $N^{th}$ display area is produced in the display area by a gray-scale data group to be displayed in the display area, and whether the number of pixel units 110 with the same color as the minimum average gray-scale value in the display area and a gray-scale value greater than or equal to a first set gray-scale value in the pixel units 110 constituting the pixel block reaches a first set value; and if yes, execute step S630; otherwise, execute step S620. When the display areas in the display module are divided in a physical manner, all display areas are fixed and relatively independent. Patterns displayed in each display area are different according to general requirements, only one color is displayed in some display areas, and two or more colors are displayed in some display areas. Alternatively, basically, only unitary color, only binary mixed color or only ternary mixed color is displayed in some display areas, while a combination of any two or three of a unitary color, a binary mixed color or a ternary mixed color may be displayed in some display areas. In some display areas, although pixel units 110 of a certain mixed color type are less in a certain displaying stage, when they are centralized in a pixel block of a certain range, setting the gray-scale value of the color corresponding to the minimum average gray-scale value in the display area to 0 according to a general control method may affect image quality. Severely, it may affect image integrity. Therefore, under a general control rule, such circumstances need to be controlled more precisely.

Step S620: Determine whether in pixel units 110 in which the color of the minimum gray-scale value in the gray-scale data group to be displayed in the $N^{th}$ display area differs from the color of the minimum average gray-scale value in the display area, the number of pixel units 110 with the same color as the minimum average gray-scale value in the display area and a gray-scale value greater than or equal to a second set gray-scale value reaches a second set value; and if yes, execute step S630; otherwise, execute step S640. The step S620 describes that in a certain display area, a main color displayed by the pixel unit 110 is same as the color of the minimum average value in the display area. In general, although the main color displayed by the pixel unit 110 is same as the color of the minimum average value in the display area, there are gray-scale values of different magnitude and amount. For pixel units 110 using the color of the minimum average value in the display area as its own main color displayed, the greater the gray-scale value of the color is, the greater its impact on an image is, and the greater the amount is, the greater its impact on the image is. On the contrary, it is reverse. Therefore, under a general control rule, such circumstances need to be controlled more precisely.

Step S630: Determine that in the $N^{th}$ display area, the gray-scale value of the color corresponding to the minimum average gray-scale value in the display area is maintained to be unchanged during the time period of displaying the gray-scale data group. When a display area has a pixel block constituted by a plurality of pixel units 110 in which the color of the minimum gray-scale value differs from the color of the minimum average gray-scale value in the display area, and the number of pixel units 110 with the same color as the minimum average gray-scale value in the display area and a gray-scale value greater than or equal to the first set gray-scale value in the pixel units 110 constituting the pixel block reaches the pre-set value, or when in pixel units 110 in which the color of the minimum gray-scale value in a gray-scale data group to be displayed in a certain display area differs from the color of the minimum average gray-scale value in the display area, the number of pixel units 110 with the same color as the minimum average gray-scale value in the display area and a gray-scale value greater than or equal to the second set gray-scale value does not reach the pre-set value, the gray-scale value of the color corresponding to the minimum average gray-scale value in the display area is maintained to be unchanged during the time period of displaying the gray-scale data group. The feature that "the display area has a pixel block constituted by a plurality of pixel units 110 in which the color of the minimum gray-scale value differs from the color of the minimum average gray-scale value in the display area" means, although an average gray-scale value of a certain color is the minimum for the whole display area, for a certain pixel block in the display area, the average gray-scale value of the color is not the minimum in the pixel block. In addition, when "the number of pixel units 110 with the same color as the minimum average gray-scale value in the display area and a gray-scale value greater than or equal to a first set gray-scale value in the pixel units 110 constituting the pixel block reaches a pre-set value", that is, when the impact of the color on the pixel block cannot be ignored, the gray-scale value of the color corresponding to the minimum average gray-scale value in the display area needs to be maintained to be unchanged during the time period of displaying the gray-scale data group, instead of setting the gray-scale value of the color corresponding to the minimum average gray-scale value in the display area to 0 according to a common practice. Otherwise, this may affect image quality or image integrity. For example, a certain display area is further divided into a first pixel block, a second pixel block, and a third pixel block, the first pixel block displays a red unitary color, the second pixel block displays a green unitary color, the third pixel block displays a blue unit, the area of the first pixel block is greater than the second pixel block, and the area of the second pixel block is greater than the third pixel block. At this point, for the whole display area, the average gray-scale value of the blue sub-pixel is the minimum, but for the third pixel block, the blue sub-pixel is the main color, and if a gray-scale value of the color corresponding to the blue sub-pixel with the minimum average gray-scale value in the display area is set to 0 at this point, the third pixel block may not be displayed, which may severely affect an originally displayed image.

Step S640: Determine that in the $N^{th}$ display area, the gray-scale value of the color corresponding to the minimum average gray-scale value in the display area is set to 0 during the time period of displaying the gray-scale data group. When in pixel units 110 in which the color of the minimum gray-scale value in a gray-scale data group to be displayed in a certain display area differs from the color of the minimum average gray-scale value in the display area, the number of pixel units 110 with the same color as the minimum average gray-scale value in the display area and a gray-scale value greater than or equal to the second set gray-scale value does not reach the pre-set value, the gray-scale value of the color corresponding to the minimum average gray-scale value in the display area is set to 0. The step describes that in a certain display area, a main color displayed by the pixel unit 110 is same as the color of the minimum average value in the display area. In general, in the event that the main color displayed by the pixel unit 110 is same as the color of the minimum average value in the display area, but gray-scale values are all smaller and less, and the color displayed thereby has less impact on an image, the gray-scale value of the color corresponding to the minimum average gray-scale value in the display area may be set to 0, thus achieving energy saving while guaranteeing that an original image is less affected.

In the above steps, the gray-scale data group to be displayed may be the first gray-scale data group or the second gray-scale data group. Preferably, the driving control method mentioned above is employed when the second gray-scale data group is displayed.

In the grouping rule, due to the rapid saturation and improvement of a view angle-brightness proportion in gray-scale liquid crystal displaying, the lower a gray-scale value is, the greater the difference between the brightness at the large angle and the brightness at a side view angle is, and therefore, in order to highlight the main color and alleviate the color shift, the lowest gray-scale data in the original gray-scale data group is put into an individual group of gray-scale data to display while colors not including the lowest gray-scale data may be displayed in other groups, thereby eliminating the impact of the color of the lowest gray scale in the group on the displaying of the main color due to the rapid saturation and improvement of the view angle-brightness proportion in gray-scale liquid crystal displaying. In order to describe the grouping rule directly and more clearly, the following description of grouping is performed with a gray-scale value group, and it should be noted that a grouping process relates to data grouping performed when processing the original gray-scale data group, and the description made with the gray-scale value group is merely for convenience and brevity:

Assuming that an original gray-scale data group corresponding to a certain pixel unit 110 is converted into an original gray-scale value group (A, B, C), that is, the gray-scale value corresponding to the red sub-pixel 111 is A, the gray-scale value corresponding to the green sub-pixel 112 is B, and the gray-scale value corresponding to the blue sub-pixel 113 is C, when A>B>C, it is determined that the gray-scale value corresponding to the blue sub-pixel 113 is the minimum gray-scale value among the original gray-scale values, that is, the lowest gray-scale value, and the difference of the lowest gray-scale value between the brightness at a front view angle and the brightness at a side view angle is the largest. In order to alleviate the impact of the lowest gray-scale value, now the lowest gray-scale value is used as a common gray-scale value of the red sub-pixel 111, the green sub-pixel 112, and the blue sub-pixel 113 so as to constitute a first gray-scale value group, that is, (C, C, C). In addition, a difference value group obtained by subtracting the lowest gray-scale value respectively from the gray-scale values corresponding to the red sub-pixel 111, the green sub-pixel 112, and the blue sub-pixel 113 in the original gray-scale data is used as a second gray-scale value group, that is (A-C, B-C, 0). Such arrangement may remove the lowest gray-scale value from the second gray-scale value group, eliminate its impact on color shift at a large view angle when it is displayed in the second gray-scale value group, improve the proportion of the sum of decomposed gray-scale values of the main color relative to low gray-scale values, and thus not only alleviate color shift at a side view angle, but also improve the brightness of the main color.

In the above content, both a gray-scale value data group and the gray-scale value group use the pixel unit 110 as the minimum unit, and are data groups respectively constituted by gray-scale data or gray-scale values corresponding to the red sub-pixel 111, the green sub-pixel 112, and the blue sub-pixel 113 respectively. The original gray-scale data group refers to an original gray-scale value data group including red, green, and blue gray-scale data and input by the display device. The original gray-scale value group refers to a gray-scale value group including the red, green, and blue gray-scale data and converted from the original gray-scale data group directly.

In the grouping rule mentioned above, the purpose of decomposing an original gray-scale data group corresponding to the binary mixed color and the unitary color into two gray-scale data groups is to keep synchronous with the execution control method for a gray-scale data group for the ternary mixed color, so as to facilitate drive and control.

Since the position and magnitude of areas divided by the display device are generally fixed relatively, when graphics and text are displayed at this point, the circumstance of a plurality of colors changing larger may occur in the same display area, that is, the color of the minimum gray-scale value of relatively more and dispensed pixel units 110 in the display area may differ from that of the minimum average gray-scale value in the display area. At this point, if a backlight unit 320 with the same color as the minimum average gray-scale value in the display area is closed when the second gray-scale data group is displayed, the presentation of colors of the sub-pixels may be affected, and therefore, determination needs to be made for whether the circumstance which occurs more in the display area and in which the color of the minimum gray-scale value of the pixel unit 110 differs from that of the minimum average gray-scale value in the display area may enable the backlight unit 320 with the same color as the minimum average gray-scale value in the display area to be closed when the second gray-scale data group is displayed.

Furthermore, the driving method further includes: improving a driving frequency of each of the pixel units 110 to 1 to 3 times, so as to compensate for a displaying speed reduced due to the decomposition of a gray-scale value. Decomposing one gray-scale value into two gray-scale values and displaying them in two consecutive time periods enable the displaying time of an image to change to two-fold, that is, the displaying speed is reduced to a half of the original, and in order to compensate for the displaying speed reduced due to the decomposition of the gray-scale value, the driving frequency may be improved.

In an embodiment, the driving frequency of each pixel unit 110 is improved to 2-fold, so as to maintain the displaying speed of the pixel unit 110 after the gray-scale value is decomposed to be same as the displaying speed before the gray-scale value is decomposed. Decomposing the original one gray-scale value into two gray-scale values and displaying them in two consecutive time periods enable the displaying time of the image to change to two-fold, that is, the displaying speed is reduced to a half of the original, and in order to maintain the displaying speed of the gray-scale value after the decomposition to be same as that before the decomposition, the driving frequency may be improved to 2-fold. Such arrangement alleviates the problem of color shift of liquid crystal displaying without damaging original visual effects.

The driving method further includes: improving the brightness of a light source of a color controlled to be in an ON state in the backlight unit 320 to 1 to 3 times, so as to compensate for the displaying brightness reduced due to the decomposition of the gray-scale value, the improvement of the driving frequency, or the combined action of the decomposition of the gray-scale value and the improvement of the driving frequency. Since the process of gray-scale value decomposition relates to decomposing an originally high gray-scale value into two new gray-scale values, that is, one group of high-voltage signals is decomposed into two groups of low-voltage signals in fact, the brightness may be reduced. On the other hand, since decomposing one gray-scale value into two gray-scale values and displaying them in two consecutive time periods enable the displaying time of the image to change to two-fold, that is, the displaying speed is reduced to a half of the original, in order to compensate for the displaying speed reduced due to the decomposition of the gray-scale value, generally, the driving frequency may be improved, and after the driving frequency is improved, the brightness may be reduced due to the time of actually displaying each gray-scale data group being shorter than that at the original driving frequency. For example, if the original driving frequency is improved to two-fold driving frequency, the actual displaying time of a driving signal changes to ½ of the time of an original driving signal, so as to result in reduction in the brightness. In order to compensate for the brightness reduced due to the decomposition of the gray-scale value, the improvement of the driving frequency, or the combined action of the decomposition of the gray-scale value and the improvement of the driving frequency, the backlight brightness may be improved.

In an embodiment, the brightness of the light source of the color controlled to be in the ON state in the backlight unit 320 is improved to 2-fold one, so as to maintain the brightness of the pixel unit 110 after the gray-scale value is decomposed to be same as the brightness before the gray-scale value is decomposed. Such arrangement aims at enabling the effect of gray-scale value decomposition and display to be substantially same as the effect of original gray-scale data display, and alleviating the problem of color shift of liquid crystal displaying without damaging the original visual effects.

In an embodiment, the pixel unit 110 includes a plurality of sub-pixels with mutually different colors. For example, it may include a yellow sub-pixel and an orange sub-pixel, etc.

The driving method for a liquid crystal display device mentioned above relates to: dividing the display module into a plurality of mutually independent display areas and providing at least one backlight unit 320 corresponding to each of the display areas on a backlight panel, where the backlight unit 320 includes a red light source, a green light source, and a blue light source; decomposing an original gray-scale data group to be displayed in each pixel unit 110 into a first gray-scale data group and a second gray-scale data group with a set grouping rule according to a type of a color corresponding to the original gray-scale data group, and displaying them in two consecutive time period respectively; calculating, respectively, average gray-scale values of a red sub-pixel, a green sub-pixel, and a blue sub-pixel from gray-scale values corresponding to original gray-scale data to be displayed in each display area, and determining the magnitude of average gray-scale values corresponding to the red sub-pixel, the green sub-pixel, and the blue sub-pixel in each display area respectively; determining whether each display area has a pixel block constituted by a plurality of pixel units 110 in which the color of the minimum gray-scale value differs from the color of the minimum average gray-scale value in the display area in which the pixel unit is located; proportioning pixel units 110 where there is larger impact on a displayed color by setting a gray-scale value of the same color as the minimum average gray-scale value in the display area to 0 in the pixel units 110 of each display area which have colors differing from that of the minimum average gray-scale value in the display area; and controlling whether to close a light source of the color corresponding to the minimum average gray-scale value in the backlight unit 320 corresponding to the display area during a time period of displaying the second gray-scale data group, or to set the gray-scale value of the color corresponding to the minimum average gray-scale value in the display area to 0. Such arrangement improves the brightness proportion of a dominant hue, so that the circumstance that color shift of the dominant hue at a large view angle is affected by a sub-pixel with low voltage is alleviated, and meanwhile, increases presentation of the brightness of a main signal at the large view angle. Furthermore, the brightness of displaying the overall image may be maintained to be unchanged by improving the backlight brightness to two-fold brightness. The speed of displaying the overall image may be maintained to be unchanged by improving a driving frequency to two-fold of an original driving frequency. Moreover, this may achieve energy saving while alleviating color shift. This may also guarantee the reality of graphic and text colors without requiring additional wiring on a liquid crystal panel, etc.

This application further provides a driving method for a liquid crystal display device, which may alleviate color shift for a particular display area.

The liquid crystal display device includes a display module 100, a driving module 200, and a backlight module 300. The display module 100 includes a plurality of pixel units 110 arranged in an array, and the pixel unit 110 includes a red sub-pixel 111, a green sub-pixel 112, and a blue sub-pixel 113. The pixel unit 110 generates a color every time it receives a gray-scale value group. The gray-scale value group is generated by gray-scale data input into the display device. The gray-scale value group includes a red gray-scale value, a green gray-scale value, and a blue gray-scale value. The color generated by the pixel unit 110 every time is of any of the following three types: a unitary color, a binary mixed color, and a ternary mixed color. The display module is divided into at least two mutually independent display areas. The driving method includes:

calculating average gray-scale values of a red sub-pixel, a green sub-pixel, and a blue sub-pixel from gray-scale values corresponding to original gray-scale data to be displayed in the $N^{th}$ display area, and determining the magnitude of average gray-scale values corresponding to the red sub-pixel, the green sub-pixel, and the blue sub-pixel in each display area; and determining whether a pixel block constituted by a plurality of pixel units 110 in which the color of the minimum gray-scale value differs from the color of the minimum average gray-scale value in a display area in which the pixel unit is located is produced in the $N^{th}$ display area by a gray-scale data group to be displayed, and whether the number of pixel units 110 with the same color as the minimum average gray-scale value in the display area and a gray-scale value greater than or equal to a first set gray-scale value in the pixel units 110 constituting the pixel block reaches a first set value; and if yes, maintaining a gray-scale value of the color corresponding to the minimum average gray-scale value in the display area to be unchanged during a time period of displaying the gray-scale data group.

When the display areas in the display module are divided in a physical manner, all display areas are fixed and relatively independent. Patterns displayed in each display area are different according to general requirements, only one color is displayed in some display areas, and two or more colors are displayed in some display areas. Alternatively, basically, only unitary color, only binary mixed color or only ternary mixed color is displayed in some display areas, while a combination of any two or three of a unitary color, a binary mixed color or a ternary mixed color may be displayed in some display areas. In some display areas, although pixel units 110 of a certain mixed color type are less in a certain displaying stage, when they are centralized in a pixel block of a certain range, setting the gray-scale value of the color corresponding to the minimum average gray-scale value in the display area to 0 according to a general control method may affect image quality. Severely, it may affect image integrity. Therefore, under a general control rule, such circumstances need to be controlled more precisely.

Moreover, when the display area has a pixel block constituted by a plurality of pixel units 110 in which the color of the minimum gray-scale value differs from the color of the minimum average gray-scale value in the display area, and the number of pixel units 110 with the same color as the minimum average gray-scale value in the display area and a gray-scale value greater than or equal to the first set gray-scale value in the pixel units 110 constituting the pixel block reaches a pre-set value, a gray-scale value of the color corresponding to the minimum average gray-scale value in the display area is maintained to be unchanged during the time period of displaying the gray-scale data group. The feature that "the display area has a pixel block constituted by a plurality of pixel units 110 in which the color of the minimum gray-scale value differs from the color of the minimum average gray-scale value in the display area" means, although an average gray-scale value of a certain color is the minimum for the whole display area, for a certain pixel block in the display area, the average gray-scale value of the color is not the minimum in the pixel block. In addition, when "the number of pixel units 110 with the same color as the minimum average gray-scale value in the display area and a gray-scale value greater than or equal to a first set gray-scale value in the pixel units 110 constituting the pixel block reaches a pre-set value", that is, when the impact of the color on the pixel block cannot be ignored, the gray-scale value of the color corresponding to the minimum average gray-scale value in the display area needs to be maintained to be unchanged during the time period of displaying the gray-scale data group, instead of setting the gray-scale value of the color corresponding to the minimum average gray-scale value in the display area to 0 according to a common practice. Otherwise, this may affect image quality or image integrity. For example, a certain display area is further divided into a first pixel block, a second pixel block, and a third pixel block, the first pixel block displays a red unitary color, the second pixel block displays a green unitary color, the third pixel block displays a blue unit, the area of the first pixel block is greater than the second pixel block, and the area of the second pixel block is greater than the third pixel block. At this point, for the whole display area, the average gray-scale value of the blue sub-pixel is the minimum, but for the third pixel block, the blue sub-pixel is the main color, and if a gray-scale value of the color corresponding to the blue sub-pixel with the minimum average gray-scale value in the display area is set to 0 at this point, the third pixel block may not be displayed, which may severely affect an originally displayed image.

In an embodiment, the driving method further includes: determining whether, in the pixel units 110 in which the color of the minimum gray-scale value in the $N^{th}$ display area differs from the color of the minimum average gray-scale value in the display area in which the pixel unit is located, the number of pixel units 110 with the same color as the minimum average gray-scale value in the display area and a gray-scale value greater than or equal to a second set gray-scale value reaches a second set value; and if yes, maintaining the gray-scale value of the color corresponding to the minimum average gray-scale value in the display area to be unchanged during the time period of displaying the gray-scale data group; otherwise, setting the gray-scale value of the color corresponding to the minimum average gray-scale value in the $N^{th}$ display area to 0 during the time period of displaying the gray-scale data group. The first set value is less than or equal to the second set value. Both n and N are integers greater than or equal to 1.

In a certain display area, a main color displayed by the pixel unit 110 is same as the color of the minimum average value in the display area. In general, although the main color displayed by the pixel unit 110 is same as the color of the minimum average value in the display area, there are gray-scale values of different magnitude and amount. For pixel units 110 using the color of the minimum average value in the display area as its own main color displayed, the greater the gray-scale value of the color is, the greater its impact on an image is, and the greater the amount is, the greater its impact on the image is. On the contrary, it is reverse. Therefore, under a general control rule, such circumstances need to be controlled more precisely. Moreover, when in pixel units 110 in which the color of the minimum gray-scale value in a gray-scale data group to be displayed in a certain display area differs from the color of the minimum average gray-scale value in the display area, the number of pixel units 110 with the same color as the minimum average gray-scale value in the display area and a gray-scale value greater than or equal to the second set gray-scale value does not reach the pre-set value, the gray-scale value of the color corresponding to the minimum average gray-scale value in the display area is set to 0. The step describes that in a certain display area, a main color displayed by the pixel unit 110 is same as the color of the minimum average value in the display area. In general, in the event that the main color displayed by the pixel unit 110 is same as the color of the minimum average value in the display area, but all gray-scale values are smaller and less, and the color displayed thereby has less impact on the image, the gray-scale value of the color corresponding to the minimum average gray-scale value in the display area may be set to 0, thus achieving energy saving while guaranteeing that an original image is less affected.

In an embodiment, the driving method further includes: determining a type of a color corresponding to the original gray-scale data according to the number of 0 gray-scale data in the original gray-scale data group to be displayed in the $n^{th}$ pixel unit 110; when the original gray-scale data group does not include 0 gray-scale data, determining that the color corresponding to the original gray-scale data group is a ternary mixed color; when the original gray-scale data group includes only one piece of 0 gray-scale data, determining that the color corresponding to the original gray-scale data group is a binary mixed color; and when the original gray-scale data group includes only two pieces of 0 gray-scale data, determining that the color corresponding to the original gray-scale data group is a unitary color. n is an integer greater than or equal to 1.

In an embodiment, the driving method further includes: dividing the original gray-scale data group into a first gray-scale data group and a second gray-scale data group with a set grouping rule according to the type of the color corresponding to the original gray-scale data group to be displayed in the $n^{th}$ pixel unit 110; and outputting and displaying the first gray-scale data group and the second gray-scale data group in two consecutive time periods respectively. n is an integer greater than or equal to 1.

In an embodiment, the first gray-scale data group is a ternary mixed color gray-scale data group, a binary mixed color gray-scale data group or a unitary color gray-scale data group, and the second gray-scale data group is a binary mixed color gray-scale data group or a unitary color gray-scale data group.

The driving method for a liquid crystal display device mentioned above relates to: decomposing an original gray-scale data group to be displayed in the $n^{th}$ pixel unit 110 into two gray-scale data groups, that is, a first gray-scale data group and a second gray-scale data group with a set grouping rule according to the type of the color corresponding to the original gray-scale data group, and displaying them in two consecutive time period respectively; calculating average gray-scale values of a red sub-pixel, a green sub-pixel, and a blue sub-pixel from gray-scale values corresponding to original gray-scale data to be displayed in the $N^{th}$ display area, and determining the magnitude of average gray-scale values corresponding to the red sub-pixel, the green sub-pixel, and the blue sub-pixel in the $N^{th}$ display area; determining whether the $N^{th}$ display area has a pixel block constituted by a plurality of pixel units 110 in which the color of the minimum gray-scale value differs from the color of the minimum average gray-scale value in the display area in which the pixel unit is located; if such pixel block exists, proportioning pixel units 110 where that is a larger impact on a displayed color by setting a gray-scale value of the same color as the minimum average gray-scale value in the $N^{th}$ display area to 0 in the pixel units 110 with the color differing from the minimum average gray-scale value in the display area in the pixel block and display area; and controlling, according to the proportion, whether to set the gray-scale value of the color corresponding to the minimum average gray-scale value in the display area to 0 during a time period of displaying the second gray-scale data group. Such arrangement improves the brightness proportion of a dominant hue of a particular display area, so that the circumstance that color shift of the dominant hue at a large view angle is affected by a low-voltage sub-pixel is alleviated, and meanwhile, increases presentation of the brightness of a main signal of the particular display area at a large view angle. Furthermore, the brightness of displaying the overall image may be maintained to be unchanged by improving the backlight brightness of the particular display area to two-fold brightness, and the speed of displaying the overall image may be maintained to be unchanged by improving a driving frequency to two-fold of an original driving frequency. This may also achieve energy saving while alleviating color shift. Not only may the reality of graphic and text colors be guaranteed, but also additional wiring on a liquid crystal panel is not required, etc.

Any "backlight unit 320" mentioned above may be used to independently and individually control light-emitting circumstances as well as opening and closing circumstances of the red, green, and blue light sources. For example, a "light-emitting unit" of the present disclosure may be used to adjust the brightness, opening and closing of any one of red light, green light, and blue light individually, and may also be used to control the brightness, proportion of mixing, opening and closing of any two or three of the red light, the green light, and the blue light.

In an embodiment, the backlight unit 320 may be any type of light-emitting units that may emit red light, green light, and blue light individually, and definition is not made here. For example, the light-emitting unit of the present disclosure may be a RGB-type LED light.

Technical features of the foregoing embodiments may be randomly combined. For the brevity of description, not all possible combinations of the technical features in the foregoing embodiments are described. However, as long as combinations of these technical features do not contradict each other, it should be considered that the combinations all fall within the scope of this specification.

The foregoing embodiments only describe several implementations of this application, which are described specifically and in detail, and therefore cannot be construed as a limitation to the patent scope of this application. It should be noted that, a person of ordinary skill in the art may make various changes and improvements without departing from the ideas of this application, which shall all fall within the protection scope of this application. Therefore, the protection scope of the patent of this application shall be subject to the appended claims.

The invention claimed is:

1. A driving method for a liquid crystal display device, wherein the liquid crystal display device comprises a display module and a backlight module; the display module comprises a plurality of pixel units arranged in an array, and the pixel unit comprises a red sub-pixel, a green sub-pixel, and a blue sub-pixel; a color generated by the pixel unit every time is of any of the following three types: a unitary color, a binary mixed color, and a ternary mixed color; the backlight module is provided with a plurality of backlight units; the backlight unit comprises a red light source, a green light source, and a blue light source; the display module is divided into at least two mutually independent display areas; and the display area corresponds to at least one of the backlight units, and the backlight units corresponding to different display areas are mutually independent, and wherein the driving method comprises:

calculating, respectively, an average gray-scale value of the red sub-pixel, an average gray-scale value of the green sub-pixel, and an average gray-scale value of the blue sub-pixel from gray-scale values corresponding to original gray-scale data to be displayed in each of the display areas;

determining the magnitudes of the average gray-scale value of the red sub-pixel, the average gray-scale value of the green sub-pixel, and the average gray-scale value of the blue sub-pixel in each of the display areas; and determining, respectively, whether a pixel block constituted by a plurality of pixel units, each of which contains a color of a minimum gray-scale value differs from a color of a minimum average gray-scale value in a display area in which the pixel unit is located, is to be produced in each of the display areas, and whether number of pixel units, each of which has a gray-scale value with the same color as the minimum average gray-scale value in the display area and greater than or equal to a first set gray-scale value, in the pixel units constituting the pixel block, reaches a first set value; and if yes, maintaining a light source of a color corresponding to the minimum average gray-scale value in a backlight unit corresponding to the display area to be opened during a time period of displaying a gray-scale data group.

2. The driving method for a liquid crystal display device according to claim 1, wherein the driving method further comprises:

determining whether, in the pixel units each of which contains the color of the minimum gray-scale value differs from the color of the minimum average gray-scale value in a display area in which the pixel unit is located, the number of pixel units, each of which has a gray-scale value with the same color as the minimum average gray-scale value in the display area and greater than or equal to a second set gray-scale value, reaches a second set value; and if yes, maintaining the light source of the color corresponding to the minimum average gray-scale value in the backlight unit corresponding to the display area to be opened during the time period of displaying the gray-scale data group; and otherwise, closing the light source of the color corresponding to the minimum average gray-scale value in the backlight unit corresponding to the display area or setting a gray-scale value of the color corresponding to the minimum average gray-scale value in the display area to 0 during the time period of displaying the gray-scale data group, wherein the first set gray-scale value is less than or equal to the second set gray-scale value; and the first set value is less than or equal to the second set value.

3. The driving method for a liquid crystal display device according to claim 1, wherein the driving method further comprises:

determining a type of a color corresponding to an original gray-scale data group to be displayed in each of the pixel units;

dividing, based on the type of the color corresponding to the original gray-scale data group to be displayed in each of the pixel units, the original gray-scale data group into a first gray-scale data group and a second gray-scale data group according to a set grouping rule; and outputting and displaying the first gray-scale data group and the second gray-scale data group in two consecutive time periods respectively.

4. The driving method for a liquid crystal display device according to claim 3, wherein the determining a type of a color corresponding to an original gray-scale data group to be displayed in each of the pixel units comprises:

determining the type of the color corresponding to the original gray-scale data according to the number of 0 gray-scale data in the original gray-scale data group to be displayed in each of the pixel units.

5. The driving method for a liquid crystal display device according to claim 4, wherein the determining the type of the color corresponding to the original gray-scale data according to the number of 0 gray-scale data in the original gray-scale data group to be displayed in each of the pixel units comprises:

when the original gray-scale data group does not comprise 0 gray-scale data, determining that the color corresponding to the original gray-scale data group is a ternary mixed color;

when the original gray-scale data group comprises only one piece of 0 gray-scale data, determining that the color corresponding to the original gray-scale data group is a binary mixed color; and when the original gray-scale data group comprises only two pieces of 0 gray-scale data, determining that the color corresponding to the original gray-scale data group is a unitary color.

6. The driving method for a liquid crystal display device according to claim 3, wherein the grouping rule comprises:

taking a minimum original gray scale data in the original gray scale data group corresponding to a ternary mixed color pixel unit as common gray scale data of the red sub-pixel, the green sub-pixel and the blue sub-pixel in the pixel unit to constitute a first gray scale data group; and taking a difference data group obtained by subtracting the first gray scale data group from the original gray scale data group corresponding to the ternary mixed color pixel unit as a second gray scale data group.

7. The driving method for a liquid crystal display device according to claim 3, wherein the grouping rule comprises:

taking the minimum non-0 gray-scale data in an original gray-scale data group corresponding to a binary mixed color pixel unit as common gray-scale data of sub-pixels corresponding to two pieces of non-0 gray-scale data in the pixel unit, together with 0 gray-scale data, to constitute the first gray-scale data group; and taking a difference data group obtained by subtracting the first gray-scale data group from the original gray-scale data group corresponding to the binary mixed color pixel unit as the second gray-scale data group of the pixel unit.

8. The driving method for a liquid crystal display device according to claim 3, wherein the grouping rule comprises:

taking gray-scale data corresponding to a half of gray-scale values corresponding to non-0 gray-scale data in an original gray-scale data group corresponding to a unitary color pixel unit as gray-scale data of sub-pixels corresponding to the non-0 gray-scale data in the pixel unit, together with 0 gray-scale data, to constitute the first gray-scale data group and the second gray-scale data group respectively.

9. The driving method for a liquid crystal display device according to claim 3, wherein the driving method further comprises:

increasing a driving frequency of each of the pixel units to 1 to 3 times, so as to compensate for a displaying speed reduced due to decomposition of a gray-scale value.

10. The driving method for a liquid crystal display device according to claim 9, wherein the driving method further comprises:

increasing brightness of a light source of a color controlled to be in an ON state to 1 to 3 times, so as to compensate for the brightness reduced due to the decomposition of the gray-scale value, the increase of the driving frequency, or the combined action of the decomposition of the gray-scale value and the increase of the driving frequency.

11. A driving method for a liquid crystal display device, wherein the liquid crystal display device comprises a display module and a backlight module; the display module comprises a plurality of pixel units arranged in an array, and the pixel unit comprises a red sub-pixel, a green sub-pixel, and a blue sub-pixel; the backlight module is provided with a plurality of backlight units; the backlight unit comprises a red light source, a green light source, and a blue light source; the display module is divided into at least two mutually independent display areas; and the display area corresponds to at least one of the backlight units, and the backlight units corresponding to different display areas are mutually independent, and wherein the driving method comprises:

calculating an average gray-scale value of the red sub-pixel, an average gray-scale value of the green sub-pixel, and an average gray-scale value of the blue sub-pixel from gray-scale values corresponding to original gray-scale data to be displayed in a $N^{th}$ display area;

determining magnitudes of the average gray-scale value of the red sub-pixel, the average gray-scale value of the green sub-pixel, and the average gray-scale value of the blue sub-pixel in the $N^{th}$ display area; and determining whether a pixel block constituted by a plurality of pixel units, each of which contains a color of a minimum gray-scale value differs from a color of a minimum average gray-scale value in a display area in which the pixel unit is located, is to be produced in the $N^{th}$ display area by a gray-scale data group to be displayed, and whether number of pixel units, each of which has a gray-scale value with the same color as the minimum average gray-scale value in the display area and greater than or equal to a first set gray-scale value, in the pixel units constituting the pixel block reaches a first set value; and if yes, maintaining a gray-scale value of the color corresponding to the minimum average gray-scale value in the display area to be unchanged during a time period of displaying the gray-scale data group, wherein N is an integer greater than or equal to 1.

12. The driving method for a liquid crystal display device according to claim 11, wherein the driving method further comprises:

determining whether, in the pixel units in which the color of the minimum gray-scale value in the $N^{th}$ display area differs from the color of the minimum average gray-scale value in the display area in which the pixel unit is located, the number of pixel units, each of which has a gray-scale value with the same color as the minimum average gray-scale value in the display area and greater than or equal to a second set gray-scale value, reaches a second set value; and if yes, maintaining the gray-scale value of the color corresponding to the minimum average gray-scale value in the display area to be unchanged during the time period of displaying the gray-scale data group; and otherwise, setting the gray-scale value of the color corresponding to the minimum average gray-scale value in the $N^{th}$ display area to 0 during the time period of displaying the gray-scale data group, wherein the first set gray-scale value is less than or equal to the second set gray-scale value; and the first set value is less than or equal to the second set value.

13. The driving method for a liquid crystal display device according to claim 11, wherein the driving method further comprises:

determining a type of a color corresponding to an original gray-scale data group to be displayed in a $n^{th}$ pixel unit;

dividing, based on the type of the color corresponding to the original gray-scale data group to be displayed in the $n^{th}$ pixel unit, the original gray-scale data group into a first gray-scale data group and a second gray-scale data group according to a set grouping rule; and outputting and displaying the first gray-scale data group and the second gray-scale data group in two consecutive time periods respectively, wherein n is an integer greater than or equal to 1.

14. The driving method for a liquid crystal display device according to claim 13, wherein the determining a type of a color corresponding to an original gray-scale data group to be displayed in the $n^{th}$ pixel unit comprises:

determining the type of the color corresponding to the original gray-scale data according to the number of 0 gray-scale data in the original gray-scale data group to be displayed in the $n^{th}$ pixel unit;

determining that the color corresponding to the original gray-scale data group is a ternary mixed color when the original gray-scale data group does not comprise 0 gray-scale data;

determining that the color corresponding to the original gray-scale data group is a binary mixed color when the original gray-scale data group comprises only one piece of 0 gray-scale data; and determining that the color corresponding to the original gray-scale data group is a unitary color when the original gray-scale data group comprises only two pieces of 0 gray-scale data.

15. The driving method for a liquid crystal display device according to claim 13, wherein the grouping rule comprises:

taking a minimum original gray-scale data in an original gray-scale data group corresponding to a ternary mixed color pixel unit as common gray-scale data of the red sub-pixel, the green sub-pixel, and the blue sub-pixel in the pixel unit, to constitute the first gray-scale data group; and taking a difference data group obtained by subtracting the first gray-scale data group from the original gray-scale data group corresponding to the ternary mixed color pixel unit as the second gray-scale data group.

16. The driving method for a liquid crystal display device according to claim 13, wherein the grouping rule comprises:

taking the minimum non-0 gray-scale data in an original gray-scale data group corresponding to a binary mixed color pixel unit as common gray-scale data of sub-pixels corresponding to two pieces of non-0 gray-scale data in the pixel unit, together with the 0 gray-scale data, to constitute the first gray-scale data group; and taking a difference data group obtained by subtracting the first gray-scale data group from the original gray-scale data group corresponding to the binary mixed color pixel unit as the second gray-scale data group of the pixel unit.

17. The driving method for a liquid crystal display device according to claim 13, wherein the grouping rule comprises:

taking gray-scale data corresponding to a half of gray-scale values corresponding to non-0 gray-scale data in an original gray-scale data group corresponding to a unitary color pixel unit as gray-scale data of sub-pixels corresponding to the non-0 gray-scale data in the pixel unit, together with 0 gray-scale data, to constitute the first gray-scale data group and the second gray-scale data group respectively.

18. The driving method for a liquid crystal display device according to claim 13, wherein the driving method further comprises:

increasing a driving frequency of each of the pixel units to 1 to 3 times, to compensate for a displaying speed reduced due to the decomposition of a gray-scale value.

19. The driving method for a liquid crystal display device according to claim 13, wherein the driving method further comprises:

increasing brightness of a light source of a color controlled to be in an ON state to 1 to 3 times, to compensate for the brightness reduced due to the decomposition of the gray-scale value, the increase of the driving frequency, or the combined action of the decomposition of the gray-scale value and the increase of the driving frequency.

20. The driving method for a liquid crystal display device according to claim 13, wherein the first gray-scale data group is a ternary mixed color gray-scale data group, a binary mixed color gray-scale data group or a unitary color gray-scale data group; and the second gray-scale data group is a binary mixed color gray-scale data group or a unitary color gray-scale data group.

* * * * *